United States Patent [19]

Coppage, Jr.

[11] Patent Number: 4,466,135

[45] Date of Patent: Aug. 21, 1984

[54] BULLETPROOF DRESS SHIRT

[76] Inventor: Edward A. Coppage, Jr., 3031 Borge St., Unit 109, Oakton, Va. 22124

[21] Appl. No.: 428,924

[22] Filed: Sep. 30, 1982

[51] Int. Cl.[3] ..... F41H 1/02

[52] U.S. Cl. ..... 2/2.5; 2/115; 2/103

[58] Field of Search ..... 2/2.5, 115, 95, 102, 2/103, 119

[56] References Cited

U.S. PATENT DOCUMENTS

| | | | |
|---|---|---|---|
| 2,647,261 | 8/1953 | Rassner | 2/115 X |
| 3,557,384 | 1/1971 | Barron et al. | 2/2.5 |
| 3,873,998 | 4/1975 | Norris et al. | 2/2.5 |
| 4,183,097 | 1/1980 | Mellian | 2/2.5 |
| 4,266,297 | 5/1981 | Atkins | 2/2.5 |
| 4,320,538 | 3/1982 | Saft | 2/103 X |
| 4,413,357 | 11/1983 | Sacks | 2/2.5 |

*Primary Examiner*—Werner H. Schroeder
*Assistant Examiner*—Judith L. Kravitz
*Attorney, Agent, or Firm*—Sherman & Shalloway

[57] ABSTRACT

A bulletproof dress shirt is disclosed which incorporates the following features: ease of installation, adjustability and removability through the use of VELCRO fasteners; lightweight design and removable bulletproof pads for ease in laundering; optional vital area protection; and design resembling a dress shirt so as to prevent other persons from discovering the fact that the garment is bulletproof, which design includes snap fasteners to permit attaching the dress shirt front over top of shoulder straps attached by the aforementioned VELCRO fasteners, to prevent detection of the shoulder straps.

10 Claims, 15 Drawing Figures

Fig. 7
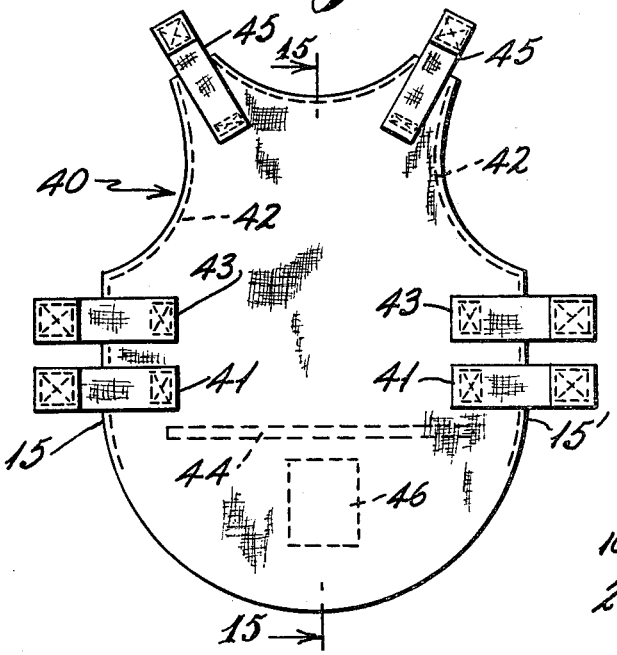
Fig. 13
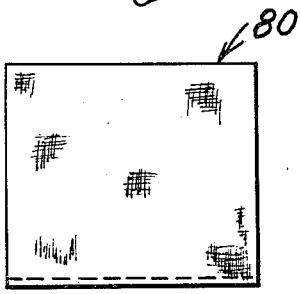
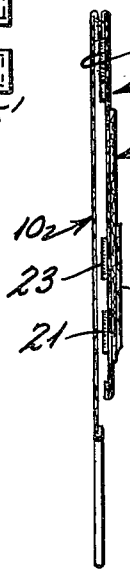
Fig. 14
Fig. 8
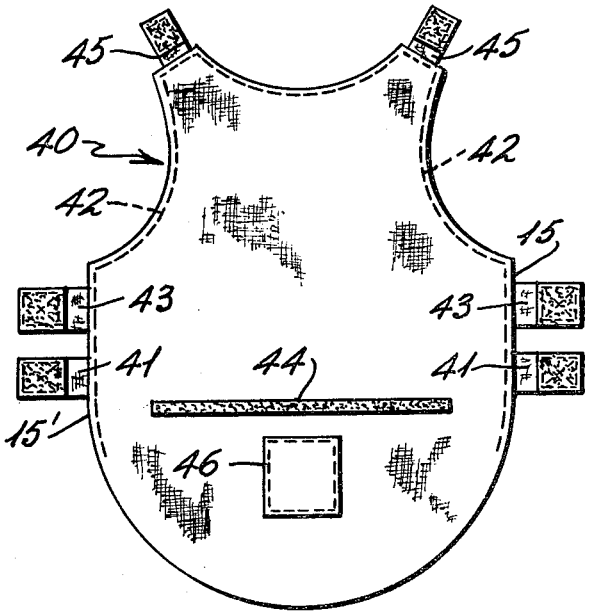
Fig. 15
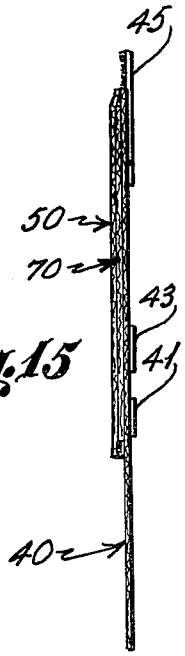

BULLETPROOF DRESS SHIRT

BACKGROUND OF THE INVENTION

This invention relates to a bullet proof dress shirt useful in protecting the torso of a man or woman, particularly those persons engaged in military or law enforcement activities.

Prior bullet proof garments, while showing effectiveness against penetration of bullets, have been beset with problems of fit and comfort. Just as troublesome has been the problem of bulkiness in prior designs which has made it quite difficult to conceal the fact that one is wearing a bullet proof garment. The following patents are good examples of the problems attendant in prior art designs:

1. U.S. Pat. No. 4,079,464 to Roggin which shows a bullet proof vest with hook and pile connections on each side to allow easy fastening but lacks any adjustment in the shoulder-neck area, and is quite bulky and uncomfortable to wear.

2. U.S. Pat. No. 3,973,275 to Blauer which shows a vest in which the front portion is composed of two parts releasably connected with hook and pile fasteners but lacks any adjustability in the neck area, utilizes uncomfortable elastic bands 42, 44 to conform to the user and does not include removable bullet proof pads or resemble a shirt.

3. U.S. Pat. No. 3,803,639 to Cohen which shows adjusting clasps 10 and 12 which are quite cumbersome to adjust and/or release.

4. U.S. Pat. No. 4,183,097 to Mellian discloses a body armor garment for women which has a very stiff back plate as well as hook and pile fasteners 29, 30 enabling the armor panels to be removed. Its major shortcomings include the fact that it is worn under the clothing and doesn't resemble an ordinary shirt or blouse.

5. U.S. Pat. No. 3,557,384 to Barron et al shows an armored vest which is disclosed as weighing "in excess of 20 lbs." and as such must be assumed to have never contemplated the concept of a lightweight bulletproof dress shirt.

6. U.S. Pat. No. 3,452,362 to Korolick et al is similar to Barron et al in that it discloses a heavy cumbersome vest which is designed with no regard for use as a lightweight dress shirt.

7. U.S. Pat. No. 4,266,297 to Atkins which shows a bullet resistant shirt-like garment. The front receptable for the ballistic panel is formed by two portions on opposite sides of button fasteners 8 which overlap when the shirt is buttoned to form the entire receptable. This construction is awkward in that it is difficult to insert the front ballistic panel when the shirt is unbuttoned and equally difficult to do so when the shirt is buttoned up while being worn.

SUMMARY OF THE INVENTION

The bulletproof dress shirt of the present invention overcomes the above noted deficiencies in the prior art garments through its unique combination of the following features:

1. Hook and pile fasteners connect the front of the shirt to the back of the shirt, both on the sides, and at the area of the neck and shoulders to make it more easily adaptable to different sized individuals.

2. The front of the shirt is made to resemble a dress shirt, and when worn over a standard dress shirt with the collar and necktie from the standard dress shirt protruding over the invention, the invention blends into the ensemble so as to become an integral part thereof.

The invention is made of a standard lightweight dress shirt material such as oxford cloth, and as such, is a comfortable article of apparel.

4. The invention incorporates integral closable pockets in the front and back of the shirt which retain in position removable bulletproof pads made of a material consisting of a series of layers of fabric made of aramid polymer yarn, preferably a fabric known by the trademark KEVLAR and manufactured by E. I. duPont de Nemours and Company.

5. The front of the shirt may also include an additional layer of fabric which includes a pocket adapted to enclose an optional bulletproof "vital area pad", the orientation and location of which may be adjusted for a particular situation.

6. All bulletproof pads are removable so that the shirt may be laundered routinely.

7. The separability of the front and back of the shirt enables substitution of different front portions of diverse colors, styles, etc.

8. The invention incorporates a method of attaching and unattaching the dress front layer to the middle layer of the vest by means of snap fasteners which permit the shirt to be fastened over the shoulders by straps while hiding the straps from view underneath the attachable dress shirt front.

BRIEF DESCRIPTION OF THE DRAWINGS

FIGS. 7 and 8 show front and rear views, respectively, of the outer layer of the rear panel of the shirt.

FIGS. 11, 12 and 13 show, respectively, the front, rear and "vital area" bulletproof pads.

FIG. 14 shows a view taken along line 14—14' of FIGS. 1, 3 and 5 showing the pads of FIGS. 11 and 13 in place in the assembled front panel.

FIG. 15 shows a view taken along line 15—15' of FIGS. 7 and 9 showing the pad of FIG. 12 in place on the assembled shirt.

DETAILED DESCRIPTION OF THE PREFERRED EMBODIMENT

Figure 1:
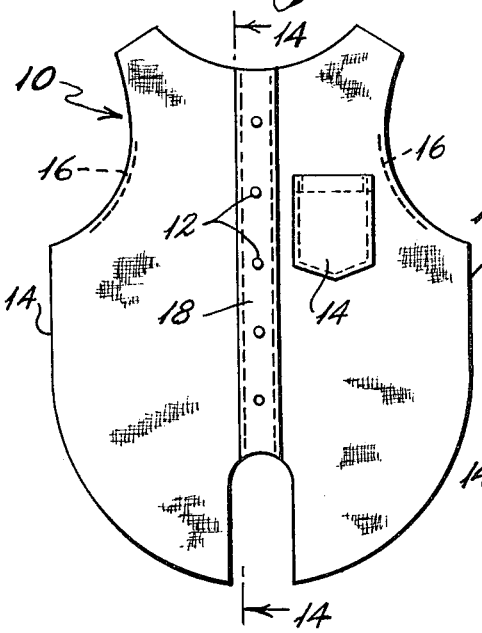
FIGS. 1 and 2 show front and rear views, respectively, of the outer layer of the front panel of the shirt.
Figure 2:
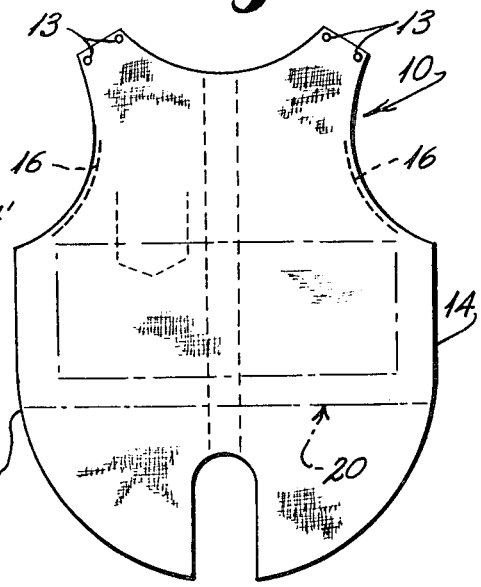

Referring to FIGS. 1–6, it is apparent that the front panel of the shirt is formed in three layers 10, 20 and 30. The outer layer 10 is that layer of the shirt that will be visible on the wearer. Layer 10 includes buttons 12, a pocket 14 and areas of stitching 16 which attach the layer 10 to the layer 20. In the preferred embodiment, the buttons appear to be retained by button hole (not shown), but the portion 18 of the shirt does not open; it is merely designed to give the appearance of a buttoning dress shirt. The pocket 14 is functional, however, and may be used by the wearer to store miscellaneous items.

Figure 3:
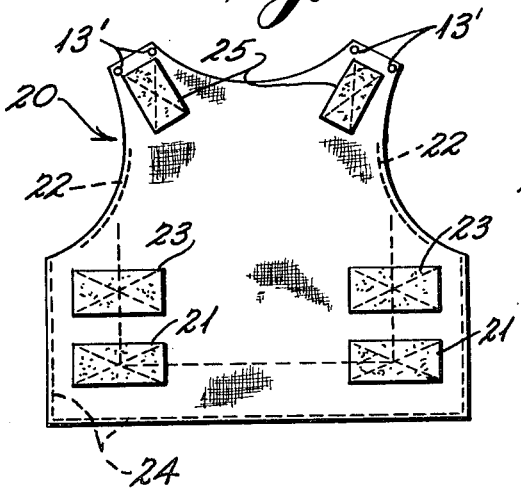
FIGS. 3 and 4 show front and rear views, respectively, of the middle layer of the front panel of the shirt.
Figure 4:
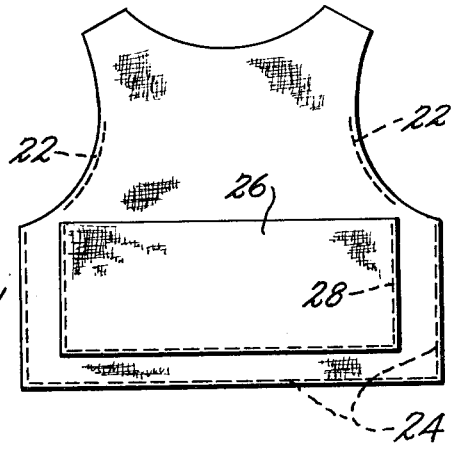

Middle layer 20 includes stitching areas 22 which attach the middle layer to the front layer and stitching areas 24 which attach the middle layer to the inner layer 30. Referring particularly to FIG. 3, hook and pile fastening material 21, 23, 25 is attached to the front of the middle layer for a purpose to be described hereinafter. FIG. 4 shows the back of the middle layer 20 which includes an optional pocket 26 sewn thereon by stitching 28. The size and orientation of pocket 26 may be varied as desired for particular individuals' individual requirements. Referring back to FIGS. 2 and 3, mating snap fasteners 13,13' are provided on outer and middle layers 10,20 for a purpose to be described hereinafter.

Figure 5:
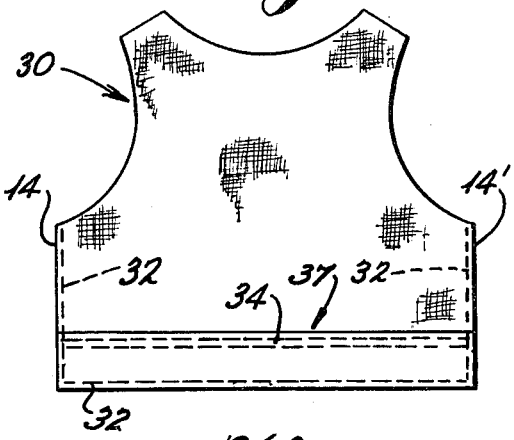
FIGS. 5 and 6 show front and rear views, respectively, of inner layer of the front panel of the shirt.
Figure 6:
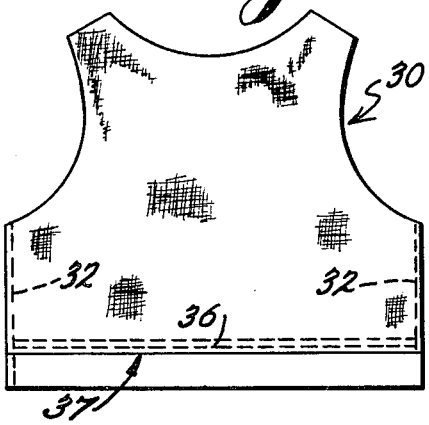

Referring to FIGS. 5–6, the inner layer 30 of the front panel is shown. The inner layer 30 includes stitching 32 which attaches the inner layer 30 to the middle layer 20 and hook and pile fastening means 34,36 to close an opening 37.

The front panel is assembled by stitching the stitching areas 12, 22, 24, 32 together as described above. When assembled, the middle and inner layers form a front panel containment area accessible by the noted opening in the inner layer.

FIGS. 7–10 depict the outer and inner layers of the rear panel of the shirt.

Referring specifically to FIGS. 7–8, the outer layer 40 of the rear panel is shown. The outer layer 40 includes hook and pile type fasteners 41, 43, 45 for a purpose to be described hereinafter. Stitching 42 is provided to enable attachment of the outer layer to the inner layer. Hook and pile fastening material 44 is attached to the back of the outer layer as is a label 46 listing washing instructions.

Figure 9:
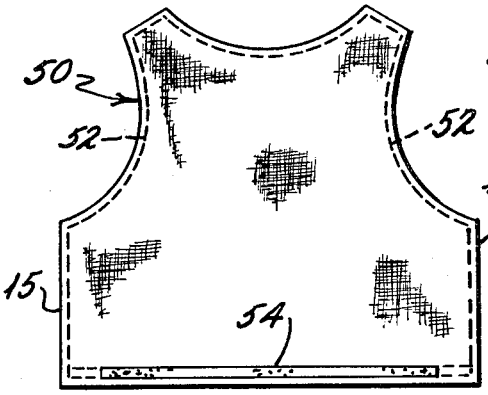
FIGS. 9 and 10 show front and rear views, respectively, of the inner layer of the rear panel of the shirt.
Figure 10:
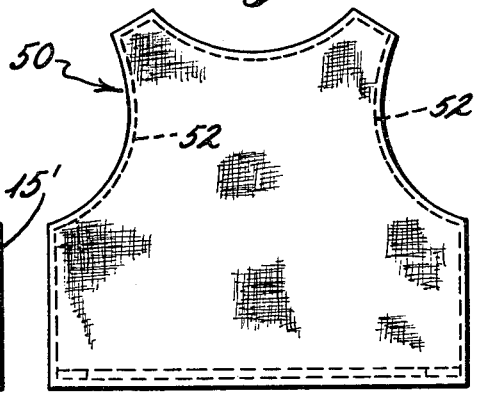

Referring to FIGS. 9–10, the inner layer 50 of the rear panel includes stitching 52 to enable attachment of the inner layer 50 to the outer layer 40 and hook and pile fastening material 54 attached to the front thereof and located so as to mate with hook and pile fastening material 44.

The rear panel is assembled by stitching the stitching areas 42, 52 together as described above. When assembled, the inner and outer layers form a rear panel containment area accessible by separating the hook and pile fasteners 44, 54.

Figure 11:
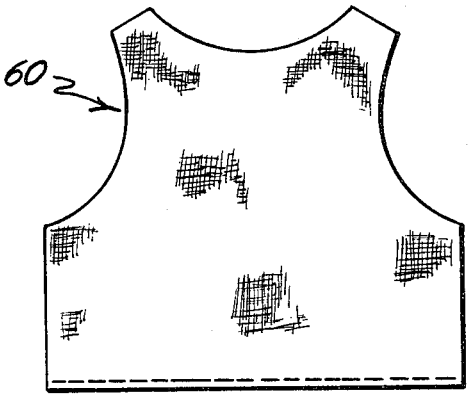
Figure 12:
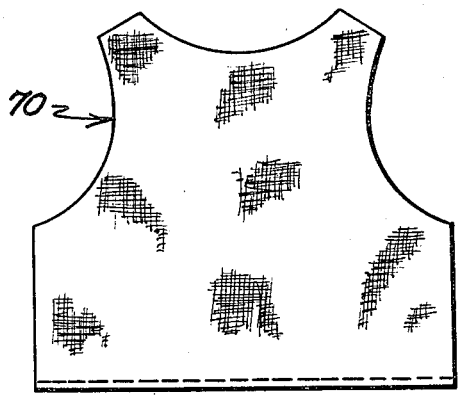

Referring to FIGS. 11, 12 and 13, the bulletproof pads 60, 70 and 80 are shown. These pads are preferably made of a series of layers of fabric made of aramid polymer yarn, preferably a fabric known by the trademark KEVLAR and manufactured by E. I. DuPont de Nemours and Company. Pad 60 is inserted into the front panel containment area through the opening 37 defined by the fastening means 34, 36; pad 70 is inserted into the rear panel containment area through the opening defined by fastening means 44, 54. If desired, vital area pad 80 may be inserted into pocket 26 to provide additional protection.

In the preferred embodiment, the hook and pile fastening means described above comprise a material sold under the trademark VELCRO. The separate hook and pile portions of the VELCRO fastener may be placed, as desired, on either of the two elements which are being fastened together.

The front panel is attached to the rear panel in the following manner: snaps 13, 13' are unfastened and with the inner layer of the rear panel facing the inner layer of the front panel, the hook and pile fasteners of the front and rear panels are connected together with fasteners 21 connected to fasteners 41, fasteners 23 connected to fasteners 43 and fasteners 25 connected to fasteners 45. Each of the fasteners is made longer than would ordinarily be necessary to retain the panels together so that adjustability of the fit of the shirt is possible. After the fasteners 25, 45 are connected, snaps 13,13' are fastened If it is desired that the garment be laundered, the pads 60, 70 and 80 are removed and the shirt is laundered following the instructions on label 46.

The owner of the shirt may own several different front panels of diverse colors, styles, etc. so that the protection from attack as well as esthetic satisfaction may be achieved.

It will be understood that various changes in the details, materials and arrangements of parts which have been herein described and illustrated in order to explain the nature of the invention may be made by those skilled in the art, and that it is intended that the invention be limited only by the limitations of the following claims.

What is claimed:

1. A bulletproof shirt comprising: a front panel and a rear panel and connecting means releasably attaching said front panel to said rear panel;

Said front panel including:

(a) an outer layer including means incorporated thereon causing said outer layer to resemble a shirt;

(b) a middle layer including a portion of said connecting means;

(c) an inner layer including a first opening bounded by first and second means releasably fastening said opening in a closed configuration;

(d) said outer layer being permanently fastened to said middle layer at one location and said middle layer being permanently fastened to said inner layer to form a front panel containment area between said inner and middle layers accessible through said first opening;

Said rear panel including:

(a) an outer layer including a portion of said connecting means and further including third releasable fastening means;

(b) an inner layer including fourth releasable fastening means engageable by said third releasable fastening means;

(c) said inner and outer layers of said rear panel being permanently fastened together so that said third and fourth releasable fastening means engage one another and provide closable access to a rear panel containment area formed between said layers;

Said shirt further including removable bulletproof pads, a first said pad being removably inserted into said front panel containment area and a second said pad being removably inserted into said rear panel containment area;

Said front and rear panels being assembled to one another by engagement of said connecting means in said panels.

2. The bulletproof shirt of claim 1, wherein said middle layer of said front panel further includes a pocket formed thereon.

3. The bulletproof shirt of claim 2 wherein a third bulletproof pad is removably placed in said pocket.

4. The bulletproof shirt of claim 1 wherein said connecting means includes hook and pile type fasteners.

5. The bulletproof shirt of claim 4 wherein said connecting means includes two pairs of interconnecting hook and pile type fasteners on each side of said front and rear panels and further includes one pair of interconnecting hook and pile fasteners, one to each side of the area of the shirt where the neck of the person wearing the shirt protrudes.

6. The bulletproof shirt of claim 5, wherein each of said hook and pile type fasteners is made sufficiently long so as to permit adjustability of the size of the shirt.

7. The bulletproof shirt of claim 1, wherein said means causing said outer layer of said front panel to resemble a shirt includes pocket means and a series of buttons appearing to protrude through button holes.

8. The bulletproof shirt of claim 1 wherein said first, second, third and fourth releasable fastening means comprise hook and pile type fasteners.

9. The bulletproof shirt of claim 1 wherein said one location where said outer layer of said front panel is permanently fastened to said middle layer of said front panel comprises side portions of said outer and middle layers and further wherein said outer and middle layers are removably attached to one another at top portions thereof.

10. The bulletproof shirt of claim 9 wherein snap fasteners removably attach said top portions together.

* * * * *